United States Patent [19]

Kapphahn

[11] Patent Number: 4,541,267

[45] Date of Patent: Sep. 17, 1985

[54] SICKLE GUARD ALIGNING TOOL

[76] Inventor: John M. Kapphahn, Rte. 1, Elbow Lake, Minn. 56511

[21] Appl. No.: 501,426

[22] Filed: Jun. 6, 1983

[51] Int. Cl.[4] ..... B21J 13/08

[52] U.S. Cl. ..... 72/458; 72/482; 72/479

[58] Field of Search ..... 72/308, 387, 388, 457, 72/458, 459, 479, 386, 478, 481, 482

[56] References Cited

U.S. PATENT DOCUMENTS

| | | | |
|---|---|---|---|
| 347,588 | 8/1886 | George . | |
| 2,075,117 | 3/1937 | Johnson | 72/386 |
| 2,322,830 | 6/1943 | Conner . | |
| 2,616,317 | 11/1952 | Hakkerup . | |
| 2,667,798 | 2/1954 | Beasley . | |
| 2,689,494 | 9/1954 | Brown . | |
| 2,705,992 | 4/1955 | Storrie . | |
| 2,718,374 | 9/1955 | Kellenbarger . | |
| 2,794,355 | 6/1957 | Geller | 72/458 |
| 2,799,193 | 7/1957 | Ferris | 81/15 |
| 2,844,060 | 7/1958 | Hagerty et al. | 72/481 |
| 2,852,971 | 9/1958 | Macaluso, Jr. | 81/15 |
| 2,922,326 | 1/1960 | Martin | 81/15 |
| 2,940,408 | 6/1960 | Monsees et al. . | |
| 3,289,446 | 12/1966 | Davey | 72/481 |
| 3,546,919 | 12/1970 | Fial . | |
| 3,729,976 | 5/1973 | Heitzman | 72/389 |
| 3,881,341 | 5/1975 | Evans . | |

*Primary Examiner*—Daniel C. Crane
*Assistant Examiner*—David B. Jones
*Attorney, Agent, or Firm*—Burd, Bartz & Gutenkauf

[57] ABSTRACT

A hand-operated tool for straightening a bent body of a sickle guard has an elongated handle supporting a shroud and fulcrum member. The fulcrum member connected to the end of the handle has spaced projections providing a recess for accommodating a portion of the sickle guard. The shroud adjustably mounted on the handle adjacent the fulcrum member has a converging pocket for accommodating the body of the bent guard so that, on movement of the handle, the shroud supplies force to the bent body of the guard to straighten the bent body and align the guard with the sickle. A releasable fastener secures the shroud in an adjusted position on the handle.

23 Claims, 20 Drawing Figures

FIG. 1
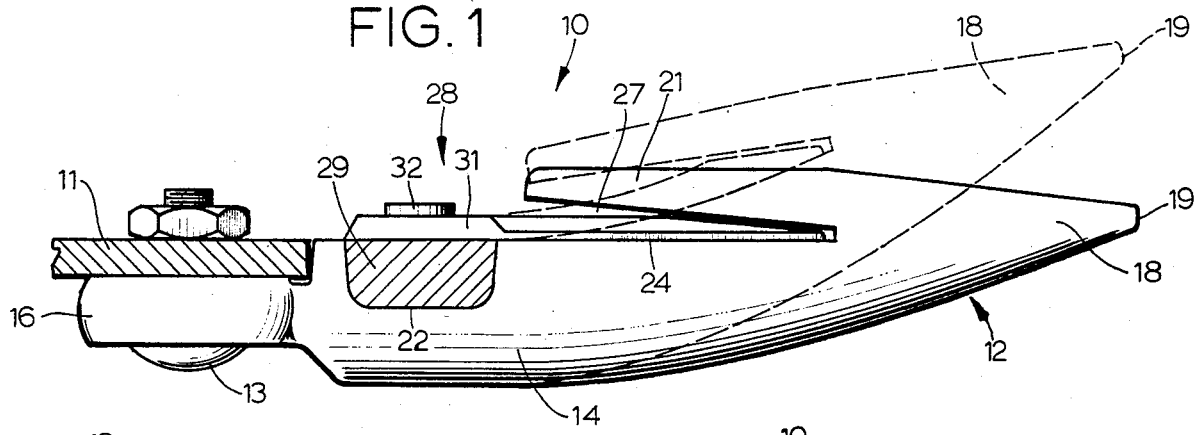
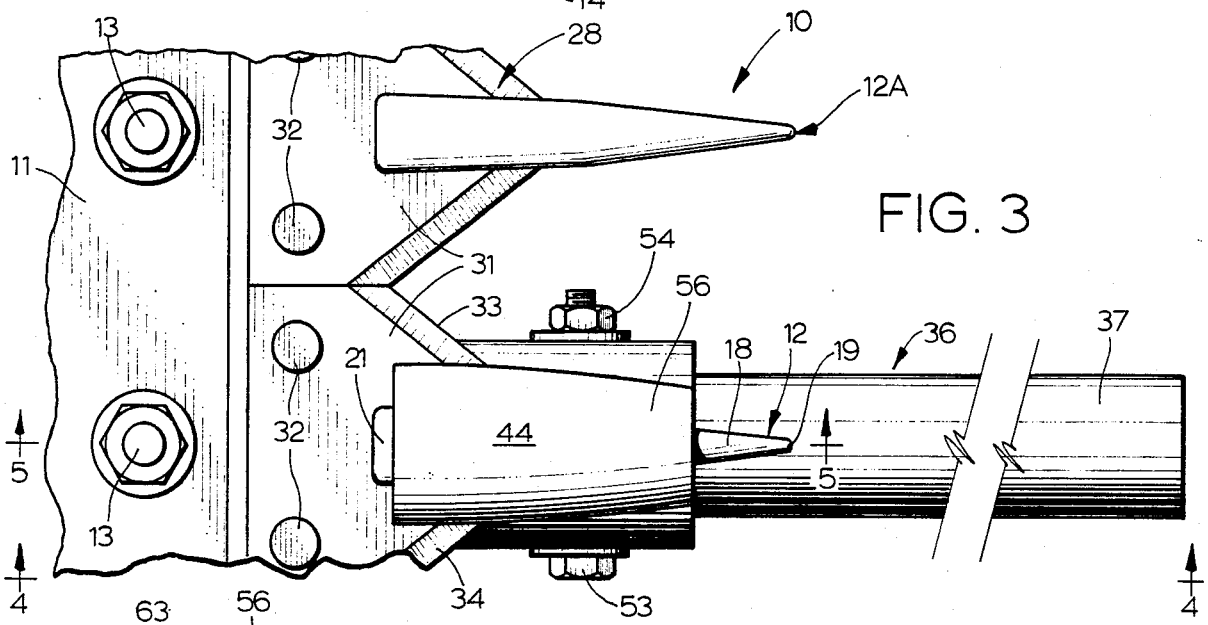
FIG. 3
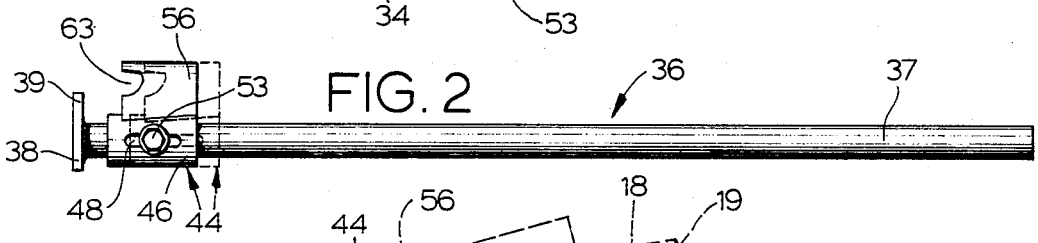
FIG. 2
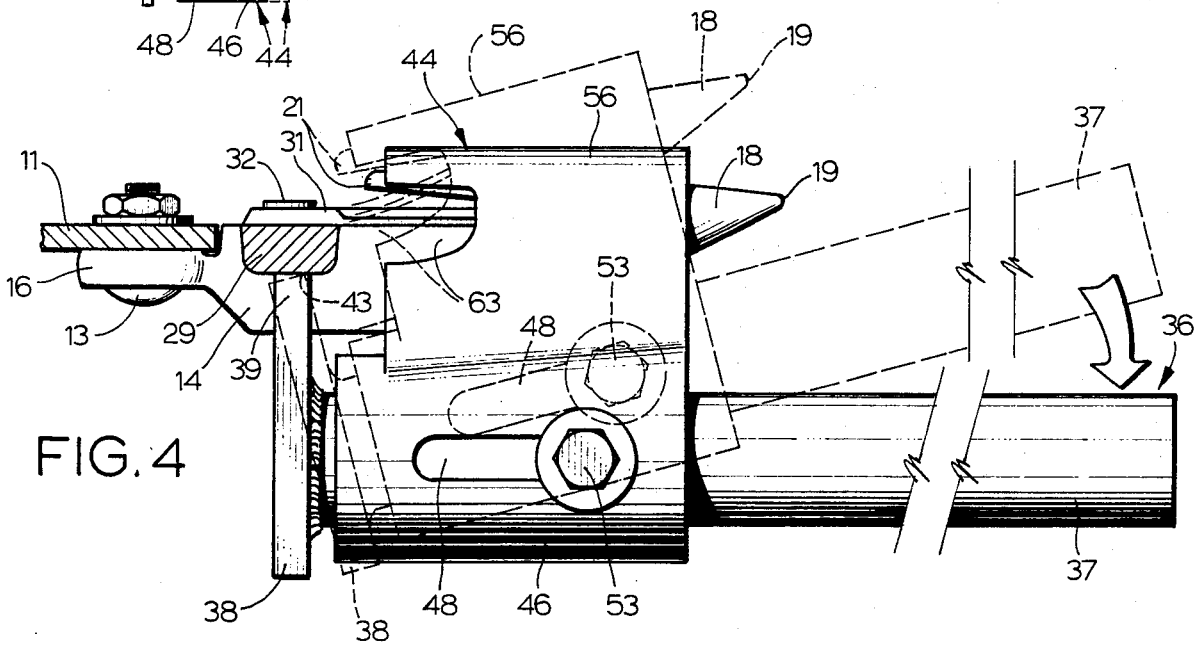
FIG. 4

SICKLE GUARD ALIGNING TOOL

FIELD OF INVENTION

The invention relates to hand tools for straightening bent guards of a sickle bar used in mowers, combines, swathers, haybines, and like machines to sever plants from the ground.

BACKGROUND OF INVENTION

Conventional sickle bars on agricultural machines have a plurality of laterally spaced guards accommodating a reciprocating sickle. The guards have longitudinal bodies that are attached at the rear end thereof to a plate. The sickle comprising a plurality of triangular-shaped knives or sections reciprocates relative to the guards to effect cutting of plants and materials that are located between the guards. The sickle bar is moved adjacent the surface of the ground during the cutting operation. The guards strike the ground and objects, such as stones, rocks, boulders, and like fixed hard objects. The sickle bar must ride over the objects. The impact forces of a guard hitting an object and the weight of the sickle bar and machine as the guard rides over the object subjects the guard to considerable force. The guards, being of malleable iron, will bend and break. Broken guards must be replaced. The bent guards are realigned with the sickle to free up the sickle. The conventional practice is to use a heavy hammer or pipe to pound and bend the guard back to its horizontal position in alignment with the sickle. The use of a hammer applies sharp impact forces to the guard causing considerable breakage of the bodies and lips of the guards.

SUMMARY OF INVENTION

The invention is a hand tool for straightening a bent body of a guard of a sickle bar. The tool is versatile in use, in that it can accommodate different types of sickle guards and bend the sickle guards from either their up-down or lateral bent positions to a longitudinal position aligned with the reciprocating sickle. The tool has an elongated handle providing a lever. A fulcrum means secured to one end of the handle is adapted to engage a portion of the guard. A housing or shroud means is movably mounted on the handle adjacent the fulcrum means. The shroud means has a pocket for accommodating a body of a bent guard so that, on movement of the handle, the shroud means is moved and applies a force to the bent guard to straighten the guard and align the guard with the sickle. The shroud means is adjustably mounted on the handle to enable different types of guards to fit into the pocket. A fastening means is used to secure the shroud means in an adjusted position on the handle.

The tool for straightening the bent body of a guard of a sickle bar has an elongated linear handle having a forward end. A fulcrum member is connected to the forward end of the handle. The fulcrum member can be fixed to the handle with a weld or releasably connected to the handle with a nut and bolt assembly. The fulcrum member has a pair of laterally spaced upright projections or ears forming a generally U-shaped recess for accommodating a portion of the guard. A one-piece cast metal shroud is adjustably mounted on the handle adjacent the fulcrum member. The shroud has wall means providing a pocket for accommodating the body of a bent guard so that, on movement of the handle, the shroud is moved and applies a force on the bent body of the guard to straighten the bent body and align the guard with the sickle. The shroud has a sleeve with a cylindrical passage accommodating a portion of the handle to allow the housing to be moved along the length of the handle. A fastening means, such as a nut and bolt assembly, is used to secure the shroud in an adjusted position on the handle. The fastening means is also used to connect the fulcrum member to the handle. The sleeve has elongated slots allowing limited linear movement of the shroud relative to the handle. The wall means of the shroud has side walls with inside surfaces that converge in the longitudinal direction of the handle away from the fulcrum member and diverge upwardly away from the handle to form the pocket having a generally triangular cross sectional shape. In use, the guard located in the pocket engages the tapered surfaces of the wall means to distribute the force applied to the handle over an area of the bent guard, whereby the guard is evenly and gradually returned to its longitudinal position in alignment with the sickle.

IN THE DRAWINGS

FIG. 1 is a sectional view of a sickle bar having a plurality of guards accommodating a reciprocal sickle;

FIG. 2 is a side view of the sickle guard straightening hand tool of the invention;

FIG. 3 is a fragmentary top view of the sickle bar with the sickle guard straightening hand tool in assembled relation with the guard;

FIG. 4 is a sectional view taken along the line 4—4 of FIG. 3;

DESCRIPTION OF PREFERRED EMBODIMENTS

Referring to FIGS. 1 and 3, there is shown a conventional sickle type cutter bar indicated generally at 10 used in mowers, combines, swathers, haybines, and like machines to sever plants from the ground. Cutter bar 10, commonly known as a sickle bar, has a flat transverse support plate 11 extended the entire width of the cutter bar. A plurality of forwardly projected guards indicated generally at 12 are secured to plate 11 with a plurality of nut and bolt assemblies 13. The guards are conventional structures that have a single body, a pair of bodies, or three bodies.

Figure 5:
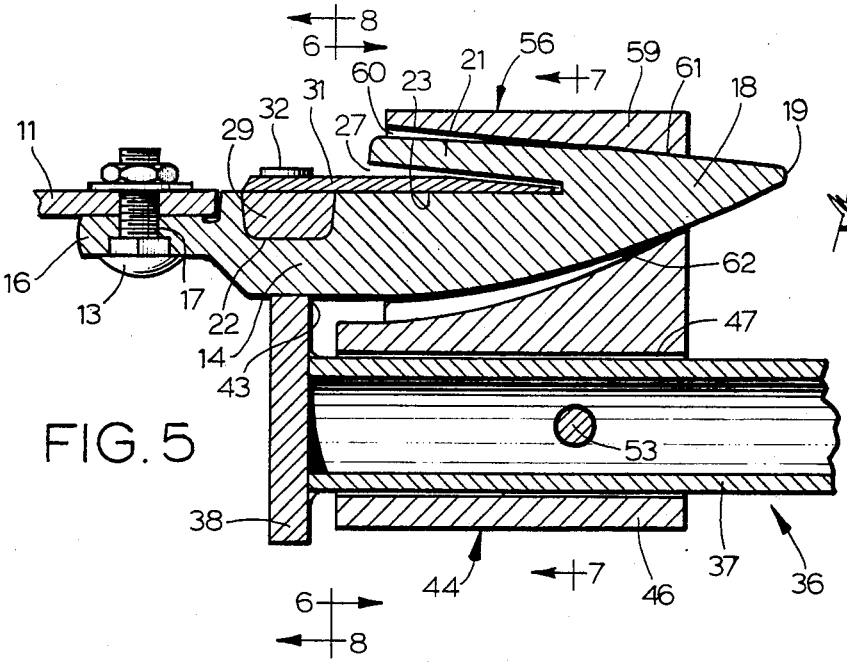
FIG. 5 is a sectional view taken along the line 5—5 of FIG. 3.

As shown in FIGS. 1 and 5, guard 12 has a longitudinal body 14 having a rear ear or flange 16 provided with a hole 17 to accommodate a nut and bolt assembly 13. The forward end of body 14 has a convergingly tapered nose 18 terminating in a forward blunt point 19. A rearwardly directed generally flat lip 21 extends from the upper portion of nose 18 over the top of body 14. The rear portion of lip 21 is forward of a transverse groove 22 in the upper portion of body 14. Body 14 has forwardly converging side cutting edges 24 and 26 located along opposite sides of a generally horizontal support surface 23. Surface 23 is spaced from the bottom of lip 21 and forms therewith a transverse horizontal recess 27. A sickle indicated generally at 28 reciprocates relative to the guards to cut all plant stems and stalks located between the sickle and the side edges of the guards.

Sickle 28 comprises a transverse bar 29 adapted to fit into transverse groove 22. A plurality of side-by-side knives or triangular blades 31 are secured with rivets 32 to bar 29. Blades 31 have forwardly converging cutting edges 33 and 34 that convergingly taper in a forward direction and cooperate with side cutting edges 24 and 26 of the guards to effect the severing of the plant material on reciprocation of the sickle 28.

In use, cutter bar 10 is moved along the surface of the ground and sickle 28 is reciprocated with a power drive mechanism (not shown). Noses 18 and bodies 14 of the guards engage objects and obstructions, such as rocks, wood, roots, soil, and the like. The guard bodies 14 are subjected to considerable force when they hit stationary or fixed objects. The bodies and noses of the guards deflect and bend. As shown in broken lines in FIG. 1, guard body 14 is bent upwards. The guard body 14 can be bent in downward or lateral directions. The bending of the guard bodies is caused by impact forces and the weight of the sickle bar and machine attached thereto as the guards ride over the object.

Returning to FIG. 1, body 14 and nose 18, shown in dotted lines, have been bent in an upward direction. This locates recess 27 out of transverse alignment with the remaining recesses of the guards. Sickle blade 31 will engage the body and prevent the sickle 28 from reciprocating. It has been the common practice to use a hammer or like heavy object to bend the guard body 14 and nose 18 back to its generally horizontal position. This results in considerable breakage of the guard bodies. A guard with a broken guard body must be removed and replaced with a new guard.

Figure 8:
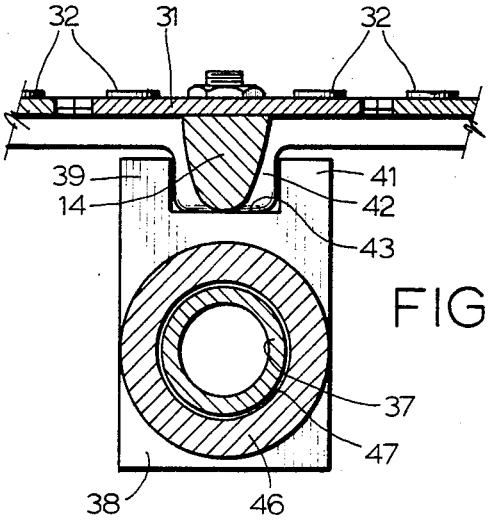
FIG. 8 is a sectional view taken along the line 8—8 of FIG. 5.

The tool of the invention indicated generally at 36 in FIG. 2 is used to straighten guards vertically and horizontally without removing the guard or sickle from the sickle bar. The guard aligning tool in FIG. 2 has an elongated linear handle 37. A fulcrum plate or member 38 is secured by welds or the like to the forward end of handle 37. As shown in FIG. 8, fulcrum member 38 has a pair of upwardly directed ears or projections 39 and 41. A generally U-shaped recess or groove 42 is located between the ears 39 and 41 for accommodating a lower portion of the guard body 14. The lower side of recess 42 has a transverse fulcrum edge 43. Fulcrum edge 43 extends between the base of ears 39 and 41.

Figure 7:
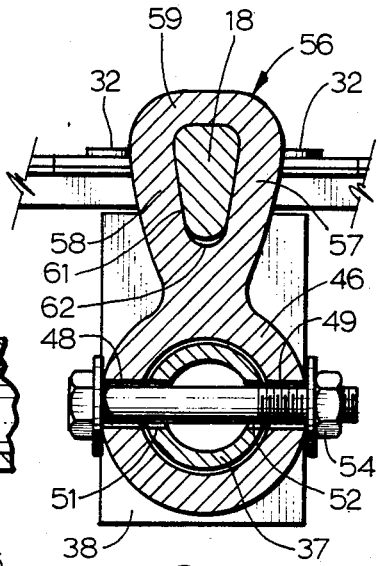
FIG. 7 is a sectional view taken along the line 7—7 of FIG. 5.

A housing or shroud indicated generally at 44 for accommodating the body 14 of the guard is adjustably mounted on handle 37 adjacent fulcrum member 38. Shroud 44 is a cast metal one-piece member having a cylindrical sleeve or base 46. Sleeve 46 has a longitudinal cylindrical passage 47 for accommodating a cylindrical section of handle 37. As seen in FIG. 5, handle 37 extends through passage 47. The outer cylindrical surface of the handle 37 is located in close sliding relation with respect to the cylindrical wall of passage 47. As shown in FIGS. 2, 4, and 7, elongated linear slots 48 and 49 are located in opposite portions of sleeve 46. Handle 37 has a pair of holes 51 and 52 aligned with the slots 48 and 49. A bolt 53 extends through slots 48 and 49 and holes 51 and 52 to hold shroud 44 in a fixed adjusted position relative to handle 37. A nut 54 threaded onto bolt 53 is turned down or tightened to lock shroud 44 in a selected position on handle 37. As shown in FIG. 2, shroud 44 can be longitudinally moved to a dotted line position to increase the space between housing 44 and fulcrum member 38. This adjustment permits the tool 36 to be used with different types and design of guards.

Figure 6:
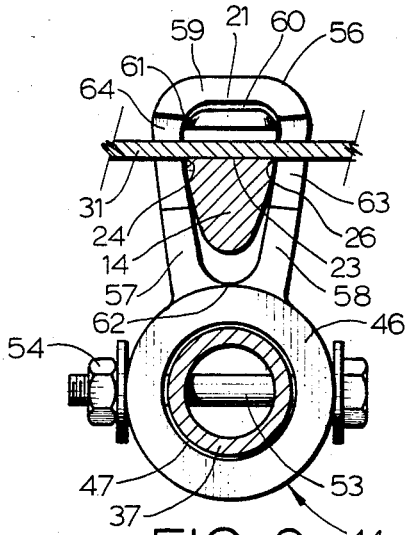
FIG. 6 is a sectional view taken along the line 6—6 of FIG. 5.

A head indicated generally at 56 is integral with the top of sleeve 46. Head 56 comprises upwardly and outwardly diverging side walls 57 and 58 integrally joined to top wall 59. The head 56 surrounds a longitudinal pocket 61. As shown in FIG. 6, the entrance to pocket 61 has a generally V-shape. This shape is generally maintained through the length of the pocket and decreases in size and converges toward the exit or rear end of head 56. As shown in FIG. 5, head 56 has an upwardly and rearwardly curved bottom portion 62 that provides an arcuate curved surface for the bottom of guard body 14. The top of guard lip 21 is spaced from the bottom of top wall 59 so that head 56 does not apply a large amount of pressure on lip 21.

As shown in FIGS. 2 and 4, side walls 57 and 58 of head 56 have rearwardly directed side recesses 63 and 64. Side recesses 63 and 64 provide clearance space for sickle blades 31 to permit movement of the shroud 44 when the tool is pivoted on guard body 14. As shown in FIG. 6, when shroud 44 is placed in assembled relation with guard body 14, sickle blade 31 extends laterally from side recesses 63 and 64.

An example of sickle guard straightening tool 36 is as follows. Handle 37 is a 1.312 inch (3.33 cm) iron pipe having a length of 36 inches (91.4 cm). Fulcrum member 38 is a 0.375 inch (1 cm) steel plate secured to the forward end of the pipe with welds. Member 38 is a rectangular plate having a size of 2×3 inches (5×7.6 cm). Member 38 has a top groove 42 having 0.75 inch (1.9 cm) sides and 1 inch (2.54 cm) base or edge 43. Shroud 44 is a one-piece cast malleable iron member having 2 inch (5 cm) slots 48 in opposite sides of cylindrical sleeve 46. Passage 47 has a 1.375 inch (3.5 cm) diameter and a length of 3.5 inches (7.6 cm). Shroud 44 has side walls 57 and 58 that taper upwardly away from sleeve 46 at an angle of 15 degrees from a vertical line bisecting pocket 61. Each inside surface of pocket 61 converges at an angle of about 15 degrees relative to a longitudinal center line of the pocket. The recess 63 in side walls 57 and 58 has a height of 0.75 inch (1.9 cm) and a longitudinal dimension of 1 inch (2.54 cm).

In use, the guard alignment tool 36 is manually used to straighten sickle guards vertically and horizontally as required to free up the sickle 28. This is done without removing sickle 28 from center bar 10. When all the guards are aligned with sickle 28, the sickle is free to reciprocate with a minimum of friction and interference. A free moving sickle reduces power requirement to operate the cutter bar and reduces wear and breakage of belts, bearings, sickle heads, and knives. Shroud 44 is initially adjusted to accommodate the type of guard used on the sickle bar. The adjustment is made by releasing the nut 54 and sliding shroud 44 to its adjusted longitudinal position relative to handle 37. Nut 54 is then turned tight to lock housing 44 in the selected adjusted position.

Guard alignment tool 36 is placed in assembled relation with the bent guard, such as guard 12, as shown in FIG. 1. Nose 18 of the guard is moved through pocket 61. The fulcrum member 38 rests on the bottom portion of guard body 14. As shown in FIG. 8, ears 39 and 41 are located adjacent opposite sides of guard body 14. An upwardly turned guard is returned to its normal horizontal position by applying a downward force on the end of handle 37. Shroud 44 exerts a downward pressure on the guard body 14 and nose 18 thereof. Tool 36 is fulcrumed on edge 43, whereby the force on the outer end of the handle 37 applies a substantial downward force on guard body 14. This force is uniformly distributed over a surface of the guard body 14 to minimize sharp force lines which cause the metal of the body to fracture.

A downwardly bent guard is returned to its horizontal position by moving the handle in an upward direction. The guards that are twisted right or left, are returned to their forward position by moving the handle right or left to apply the desired bending forces to the guard body. The ears 39 and 41 provide fulcrums when handle 37 is laterally moved.

Figure 9:
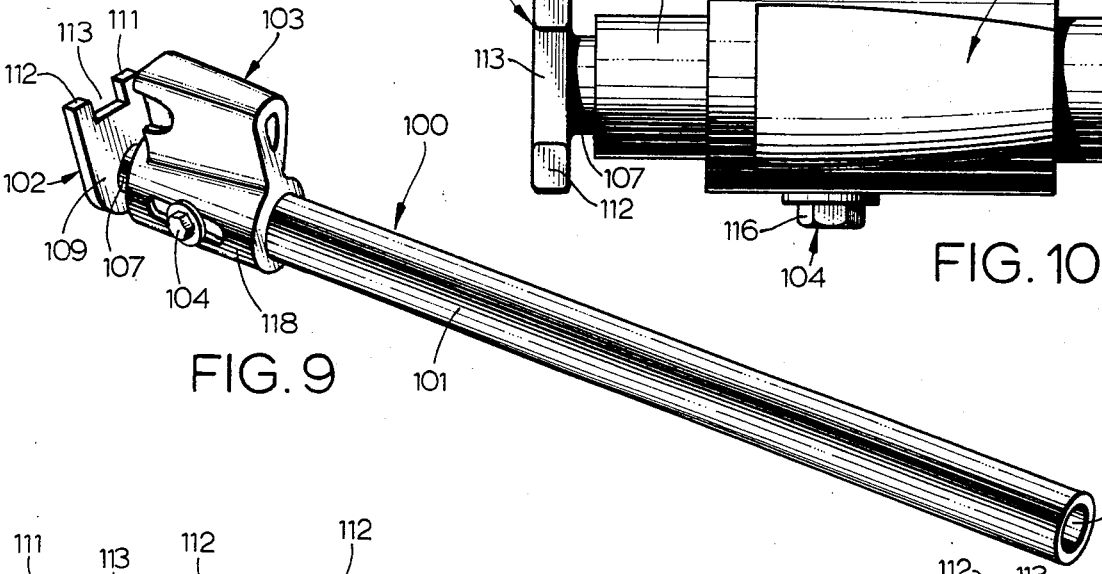
FIG. 9 is a perspective view of a modification of the sickle guard straightening hand tool.
Figure 10:
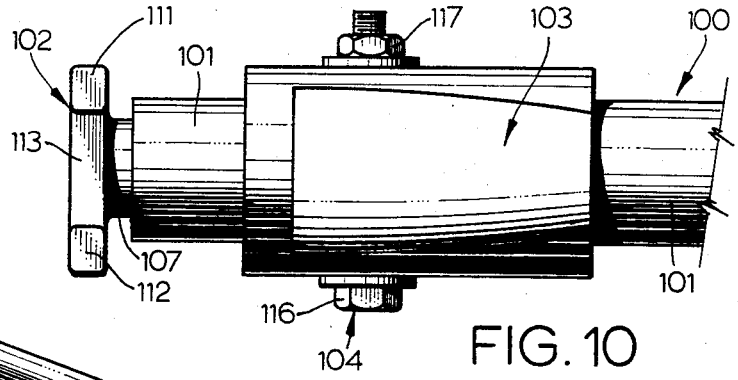
FIG. 10 is an enlarged plan view of the shroud and fulcrum end of the tool of FIG. 9.
Figure 11:
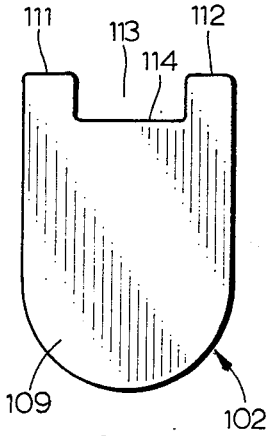
FIG. 11 is an end view of the fulcrum member of the tool of FIG. 9.
Figure 12:
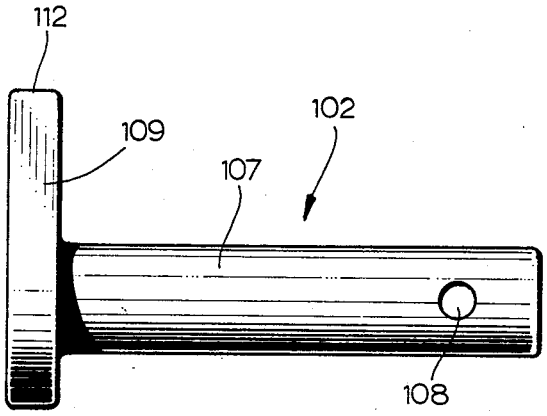
FIG. 12 is a side elevational view of the fulcrum member of the tool of FIG. 9.
Figure 13:
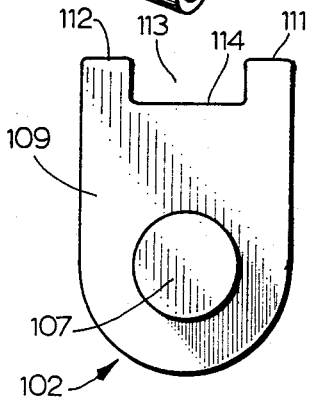
FIG. 13 is an end view of the right end of FIG. 12.

Referring to FIGS. 9 and 10, there is shown a modification of the sickle guard aligning tool of the invention indicated generally at 100. Tool 100 has an elongated handle 101 in the form of a pipe. A fulcrum member 102 is attached to the forward end of handle 101. Handle 101 supports a shroud or housing 103 adjacent fulcrum member 102. A holding unit 104, shown as a nut and bolt assembly, secures fulcrum member 102 and shroud 103 to handle 101.

Figure 17:
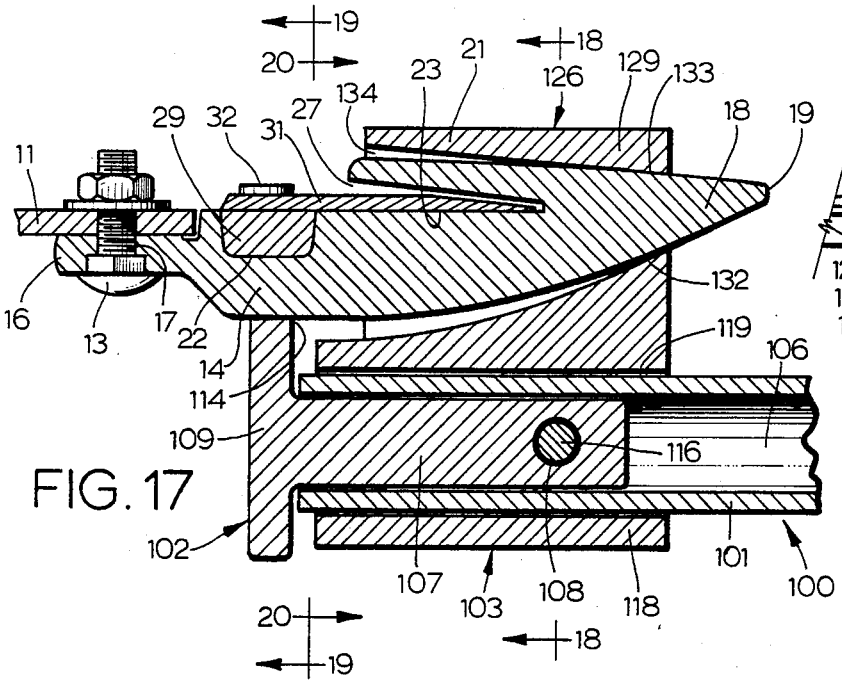
FIG. 17 is a longitudinal sectional view of the shroud and fulcrum end of the hand tool of FIG. 9 in assembled relation with a guard.

Handle 101 is an elongated metal tubular member or pipe having a cylindrical passage 106. Fulcrum member 102 has a cylindrical stem 107 adapted to insert into the forward end of passage 106, as shown in FIG. 17. Stem 107 has a transverse hole 108 accommodating holding unit 104. Fulcrum member 102 has a transverse head 109 located in engagement with the forward end of handle 101. The upper end of head 109 has a pair of laterally spaced ears 111 and 112. A transverse recess 113 is located between the ears 111 and 112. Head 109 has a transverse fulcrum edge 114 extended between ears 111 and 112. Edge 114 forms the base or bottom of recess 113.

Fulcrum member 102 is a one-piece cast metal member adapted to be inserted into the passage 106 and retained therein with a holding unit 104. Holding unit 104 comprises a bolt 116 and a nut 117 shown in FIG. 18.

Figure 18:
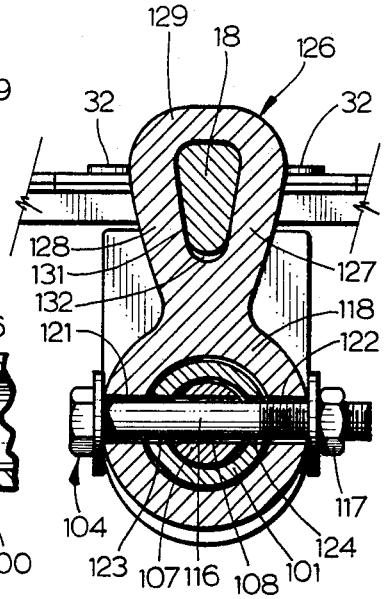
FIG. 18 is a sectional view taken along the line 18—18 of FIG. 17.

Shroud 103, shown in FIGS. 14–20, has a cylindrical sleeve 118 providing a cylindrical passage 119. The forward end of handle 101 projects through passage 119. Sleeve 118 has a pair of longitudinal side slots 121–122 aligned with the fastening holding unit 104. Handle 101, as shown in FIG. 18, has a pair of holes 123 and 124 aligned with the slots 121 and 122 to accommodate bolt 116. Slots 121 and 122 allow housing 103 to be longitudinally adjusted on handle 101 to permit the sickle guard aligning tool to be used with different types of guards.

Figure 14:
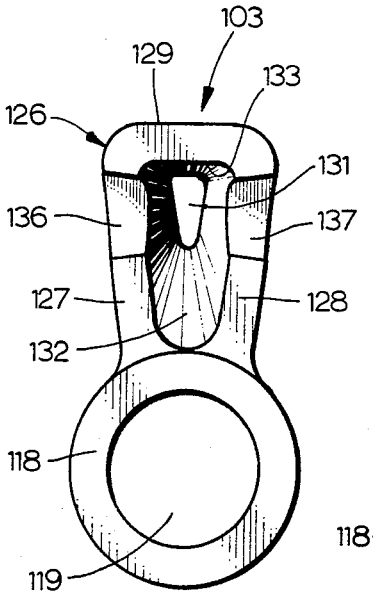
FIG. 14 is an end view of the shroud of the tool of FIG. 9.
Figure 15:
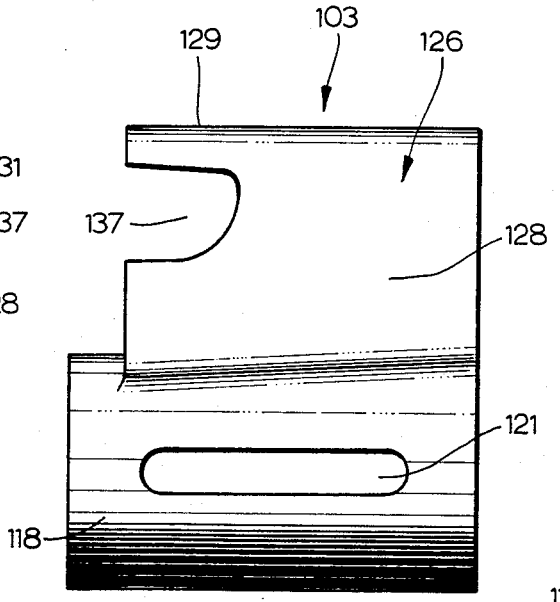
FIG. 15 is a side view of the shroud of the tool of FIG. 9.
Figure 16:
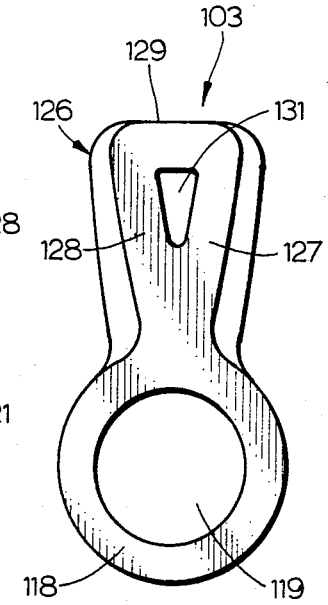
FIG. 16 is an end view of the right end of FIG. 15.

Shroud 103 has a head 126 integral with the top of sleeve 118. The head 126 has upwardly diverging side walls 127 and 128 joined to a transverse top wall 129. The walls 127, 128, and 129 form a forwardly convergingly tapered pocket 131. The bottom of head 126 has a concave bottom surface or potion 132 to accommodate the curved portion of the guard nose 18. The upper portion of housing 126 has an internal tapered top surface or portion 133 adapted to engage a forward portion of nose 18. The rear portion of the top wall 129 is located above or spaced, as indicated at 134, from the top of the guard lip 21. The space 134 allows shroud 103 to move relative to the guard without applying a large amount of pressure on lip 21. As shown in FIG. 14, the entrance to pocket 131 has a generally V-shape. This shape is generally maintained throughout the length of the pocket and decreases in size toward the exit or rear end of head 126. The pocket converges toward the exit or rear end of head 56.

Figure 20:
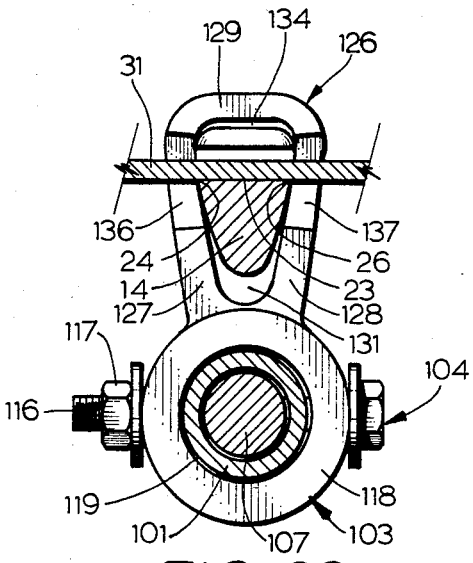
FIG. 20 is a sectional view taken along the line 20—20 of FIG. 17.

As shown in FIGS. 14 and 20, side walls 127 and 128 of head 126 have rearwardly directed side recesses 136 and 137. Side recesses 136 and 137 provide clearance spaces for the sickle blades 31. As shown in FIG. 17, when the housing 106 is placed in assembled relation with guard body 14, sickle blade 31 extends laterally through side recesses 136 and 137.

Guard alignment tool 100 is used in the same manner as guard alignment tool 36. The holding unit 104 permits longitudinal adjustment of shroud 103 relative to the head 109 of fulcrum member 102. This permits the longitudinal spacing of pocket 131 from fulcrum edge 114. The longitudinal adjustment of shroud 103 allows the sickle guard aligning tool 100 to be used with different size and length of guards. Holding unit 104 maintains the fulcrum member 102 in fixed assembled relation with the forward end of handle 101. The bolt 116 extending through hole 108, as shown in FIG. 18, prevents the fulcrum member 102 from rotating relative to handle 101 and holds head 119 in engagement with the forward end of handle 101. The bolt 116 also holds the housing 103 in an adjusted position relative to the forward end of handle 101.

Shroud 103 is initially adjusted to accommodate the type of guard used on the sickle bar. The adjustment is made by releasing nut 117 and sliding shroud 103 to the selected longitudinal position on handle 10. Nut 117 is then turned tight to lock shroud 103 in a selected adjusted position.

Figure 19:
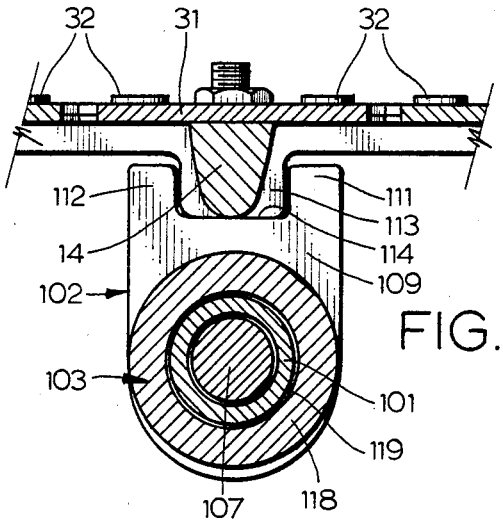
FIG. 19 is a sectional view taken along the line 19—19 of FIG. 17.

Referring to FIGS. 17–20, guard alignment tool 100 is placed in assembled relation with a bent guard with body 18 of the guard located in pocket 131. The forward end or nose 19 of the guard projects through pocket 131. The arcuate curved bottom portion of the guard body 14 rests on the curved surface 132 of head 126. The top forward portion of the guard body 18 rests on the forward section 131 of the head 132. Lip 21 is spaced from the top wall 129. Fulcrum member 102 rests on the bottom portion of guard body 14. Ears 111 and 112, as shown in FIG. 19, are positioned adjacent opposite sides of guard body 14. An upwardly turned guard is returned to its normal horizontal position by applying a downward force on the end of handle 101. Shroud 102 exerts a downward pressure on the guard body and nose. This pressure is generally uniformly distributed over a surface area of the guard body to minimize sharp force lines, which cause the metal of the body to fracture. The guard lip 21 being spaced from the top wall 129 is subjected to a minimum of force. Tool 100 is fulcrumed onto the fulcrum edge 114. A downward force on the outer end of handle 101 applies a substantial downward force on guard body 14.

A downwardly bent guard is returned to its horizontal position by moving the handle in an upward direction. Guards that are twisted right or left are returned to their forward position by moving the handle right or left to apply a desired bending force on the guard body. The ears 111 and 112 provide alternate fulcrums when handle 101 is laterally moved.

While there has been shown and described examples of the guard straightening tool of the invention, it is understood that changes in parts, materials, and size of the parts may be made by one skilled in the art without departing from the invention. The invention is defined in the following claims.

The embodiments of the invention in which an exclusive property or privilege is claimed are defined as follows:

1. A tool for straightening a bent body of a guard of a sickle bar comprising: an elongated handle having an end, a fulcrum member attached to the end of the handle adapted to engage a portion of the guard, and a shroud mounted on the handle adjacent the fulcrum member, said shroud having wall means providing a pocket for accommodating a body of a bent guard, said pocket having a generally tirangular shaped cross section, and said wall means having an inside surface that converges away from the fulcrum member and diverges away from the handle, whereby on movement of the handle the shroud is moved and applies force on the bent body to straighten said bent body, said shroud including sleeve means having a passage accommodating a portion of the handle to allow the shroud to move relative to the handle in the longitudinal direction thereof, said sleeve means having slots in opposite sides thereof extended in the longitudinal direction of the handle, said handle having a hole aligned with said slots, and fastening means extended through said slots and hole securing the sleeve means in an adjusted position on the handle, thereby locating the shroud in a selected position relative to the fulcrum member to accommodate the body of a guard.

2. The tool of claim 1 wherein: said fulcrum member having a pair of spaced projections and edge means extended between said projections forms a generally U-shaped recess for accommodating a portion of the guard.

3. The tool of claim 1 wherein: the handle is an elongated linear tubular member having a passage, and said fulcrum member having a portion extended into said passage, said portion having a transverse hole aligned with the hole in the handle, said fastening means extend through said transverse hole

4. The tool of claim 1 wherein: said pocket converges in the longitudinal direction of the handle away from the fulcrum member.

5. The tool of claim 4 wherein: said wall means has side recesses to accommodate portions of the sickle bar.

6. The tool of claim 1 wherein: said fastening means extended through said slots comprise a nut and bolt assembly.

7. The tool of claim 1 wherein: said wall means has side recesses to accommodate portions of the sickle bar.

8. The tool of claim 1 wherein: said fulcrum member has a head and fulcrum body, said fulcrum body mounted on said handle, said fastening means securing the fulcrum body to said handle.

9. The tool of claim 8 wherein: said end of the handle has a passage, said fulcrum body being located in said passage.

10. The tool of claim 8 wherein: said fulcrum body having a transverse hole aligned, with the hole in the handle, said fastening means comprising a bolt extended through said aligned holes, and slots, and a nut threaded on said bolt to hold the shroud in the adjusted position on the handle.

11. The tool of claim 8 wherein: said head has a pair of spaced projections and edge means extended between said projections forming a generally U-shaped recess for accommodating a portion of the guard body.

12. The tool of claim 11 wherein: said wall means has an inside surface that converges away from the head and diverges away from the handle forming said pocket.

13. The tool of claim 12 wherein: said wall means has side recesses to accommodate portions of the sickle bar.

14. The tool of claim 8 wherein: said wall means has side recesses open toward said fulcrum member to accommodate portions of the sickle bar.

15. A tool for straightening a bent body of a guard of a sickle bar comprising: an elongated handle, fulcrum means attached to the handle adapted to engage a portion of the guard, shroud means mounted on the handle having a pocket for accommodating a body of a bent guard, said pocket having a generally triangular shaped cross section, and said wall means having an inside surface that converges away from the fulcrum member and diverges away from the handle, whereby on movement of the handle the shroud means is moved and applies force on the bent body to straighten said bent body, said shroud means having slot means extended in the longitudinal direction of the handle, said handle having hole means aligned with the slot means, and fastening means extend through the slot means and hole means securing the shroud means to the handle whereby the position of the shroud means relative to the fulcrum means is adjustable to accommodate the body of a guard.

16. The tool of claim 15 wherein: the shroud means has a passage accommodating a portion of the handle to allow the shroud means to move relative to the handle.

17. The tool of claim 15 wherein: the fulcrum means has a pair of spaced projections and an edge extended between said projections forming a generally U-shaped recess for accommodating a portion of the guard.

18. The tool of claim 15 wherein: said shroud means has a sleeve, said sleeve having said passage for the handle and said slot means.

19. The tool of claim 15 wherein: said means securing the shroud means to the handle comprises a nut and bolt assembly.

20. The tool of claim 15 wherein: said shroud means has side recesses to accommodate portions of the sickle bar.

21. The tool of claim 15 wherein: the fulcrum means has a head and fulcrum body, said fulcrum body mounted on said handle, said body having a transverse hole aligned with the hole means, said fastening means extended through the transverse hole securing the fulcrum body to the handle.

22. The tool of claim 21 wherein: said fastening means comprises a bolt extended through said aligned hole and hole means.

23. The tool of claim 22 wherein: said shroud means includes a sleeve mounted on said handle, said sleeve having said slot means extended in the longitudinal direction of the handle, said bolt extended through said slot means, and means attached to said bolt to hold the shroud means in an adjusted position on the handle.

* * * * *